United States Patent [19]

Reaume et al.

[11] 4,335,762

[45] Jun. 22, 1982

[54] LOG SPLITTER ATTACHMENT FOR GARDEN TILLER

[75] Inventors: Leonard V. Reaume, Natchez Trace Village; James O. Hall, Jackson, both of Miss.

[73] Assignee: Magna American Corporation, Raymond, Miss.

[21] Appl. No.: 966,853

[22] Filed: Dec. 6, 1978

[51] Int. Cl.[3] ..... B27L 7/00

[52] U.S. Cl. ..... 144/194; 74/11; 144/193 R; 172/125; 172/247; 180/53 FE; 180/53 C

[58] Field of Search ..... 172/14, 42, 43, 125, 172/247, 292; 180/53 R, 53 WA, 19, 198, 53 FE, 53 C; 144/193 R, 194; 74/13, 15, 15.6, 15.63, 11

[56] References Cited

U.S. PATENT DOCUMENTS

| | | | |
|---|---|---|---|
| 1,487,962 | 3/1924 | Manville | 180/53 WA |
| 2,137,940 | 11/1938 | Goodman | 180/53 WA |
| 2,577,448 | 12/1951 | Carr | 180/53 C |
| 2,746,492 | 5/1956 | Hardit | 180/53 FE |
| 2,778,233 | 1/1957 | Perry . | |
| 3,670,789 | 6/1972 | Long | 144/194 |
| 3,993,113 | 11/1976 | Thackery | 144/194 |
| 4,026,337 | 5/1977 | Thackery | 144/193 R |
| 4,027,709 | 6/1977 | Thackery | 144/193 R |
| 4,132,255 | 1/1979 | Thackery | 180/53 WA |

OTHER PUBLICATIONS

Most Machine for Your Money, Roto-Hoe & Sprayer Co., p. 13, "The Roto-Buzz Saw"; 1954.

*Primary Examiner*—W. D. Bray
*Attorney, Agent, or Firm*—Frost & Jacobs

[57] ABSTRACT

This invention resides in a log splitter attachment for garden tiller, a unique bearing arrangement for same, and the combination of a garden tiller and such an attachment. The attachment includes a rigid ground engaging base frame having means thereon to support the tiller tine shaft of a garden tiller and a log to be split. Preferably the base frame will also support the garden tiller itself when used with the log splitter attachment. An auger is provided and is mounted on a shaft adapted to slip over one end of the tiller tine shaft. The auger shaft is secured to the tiller tine shaft and supported in a bearing member which is affixed to the base frame. The other end of the tine shaft is engaged within a spacer located in a corresponding bearing member and the spacer is attached to the tine shaft. Preferably the bearing members for the tine shaft are slotted just enough to receive the tine shaft but not the auger shaft or spacer; these enter the bearing member axially thereof and cannot pass through the slots. The auger extends to one side of the base frame. A log holding member is fastened to the base frame and extends to the same side as the auger, being spaced from but parallel to such auger. When the tiller motor is actuated so as to drive the tiller tine shaft, the auger and auger shaft will rotate therewith. The operator then moves a log, supported at one end on the log support, into contact with the auger whereafter the auger screws itself into the log to split it open.

15 Claims, 3 Drawing Figures

LOG SPLITTER ATTACHMENT FOR GARDEN TILLER

TECHNICAL FIELD

This invention resides in providing an arrangement which makes it possible to adapt the principal of using a screw for splitting wood to a garden tiller so that power from the tiller is utilized via a light weight removable accessory to actuate the screw auger. The garden tiller attachment has particular utility in the splitting of firewood.

BACKGROUND ART

It is known to use a screw to split wood. There are auger wood splitting attachments which may be attached to the power takeoff of a tractor while some may receive their power from the wheel of an automobile. There are auger log splitters utilizing a gasoline powered engine to drive an auger supported by a wheeled carriage.

A preliminary patentability search of the United States patent art developed the following U.S. Pat. Nos.: 2,778,233 Perry; 3,670,789 Long; 3,993,113 Thackery; 4,026,337 Thackery; and 4,027,709 Thackery. No representation is made that these patents represent the closest art although it was the intent of the search to develop such art. Perry illustrates a garden tiller having means for supporting interchangeable power operated tools such as lawn mowing tools, edgers, grinders and so forth; no specific mention is made, however, of log splitters or similar devices. Long illustrates an auger-type log splitter driven by an electric motor, the entire assembly being self contained.

Thackery U.S. Pat. No. 3,993,113 illustrates an auger-type log splitter attachable to the powered wheel of a vehicle, and it is mentioned therein that the power source may be a garden tractor wheel. Thackery U.S. Pat. No. 4,026,337 illustrates another type of auger arrangement driven by a vehicle wheel utilizing lug extenders. Thackery U.S. Pat. No. 4,027,709 illustrates an auger type splitting tool attachable to a wheel of a tractor and including a tractor supporting and lifting framework.

Copies of the five patents above identified are attached hereto.

DISCLOSURE OF THE INVENTION

This invention resides in the provision of a log splitter attachment for a garden tiller. The attachment includes a support frame designed in such a way that the tiller drive shaft is supported by the frame during the log splitting operation. Support of the entire drive shaft by the support frame is achieved by having the tiller drive shaft received in cylindrical support ends, the drive shaft having first been inserted via slots arranged just nicely to receive it, the slots being located in bearing blocks provided at the upper ends of vertical standards which are a part of the support assembly. When the tube that forms the shaft on the auger screw assembly is then inserted over the drive shaft and into the cylindrical support end on the standard, the support assembly provides not only a support for the drive shaft but also a journal bearing therefor, and a method of driving the auger screw from the tiller power source. Since the outer diameter of the tube for the auger screw assembly is greater than the width of the slot through which the tiller drive shaft was inserted into the cylindrical support end, the tiller shaft is prevented from coming loose from the standards and support assembly during the log splitting operation. Furthermore the use of the tube, coupled with a corresponding cylindrical bearing member placed over the other end of the tiller shaft and located within a corresponding cylindrical support end on another of the vertical standards, will prevent any wear and tear on the tiller drive shaft so that, when the tiller is again used for tilling purposes, the drive shaft will remain in good condition for that operation.

Thus the wood splitting invention comprises a thread auger rotatably supported on a frame and powered by the transmission of a conventional garden tiller, the tiller having the tines removed. The support frame comprises a generally rectangular base member having a pair of spaced upstanding vertical standards having slotted cylindrical blocks at the upper ends thereof to receive the tiller tine shaft. The auger assembly is slidably received on one end of the tiller shaft and secured thereto by a clevis pin. The auger assembly preferably includes a replaceable point. The frame also includes a rest arm extensible from the rectangular frame for supporting an end of the log to be split. A kill switch is also included at the end of the rest arm, near where the operator's foot will be, for cutting off power to the tiller tine shaft in case of an emergency.

In operation, a log is rested on the rest arm and pressed forwardly against the point of the auger, the rotating auger operating to split the log. During this wood splitting operation the entire drive shaft (the tiller tine shaft) of the driving unit (the tiller and its associated power and transmission means) is supported on the auxiliary frame. Preferably the auger screw is provided with a replaceable point. The rest arm for the log is a part of the auxiliary support assembly.

Broadly speaking then, this invention resides in the adaptation of a garden tiller for the splitting of logs while containing the involved forces in a light weight removable accessory.

DETAILED DESCRIPTION OF THE INVENTION

Figures 1, 3:
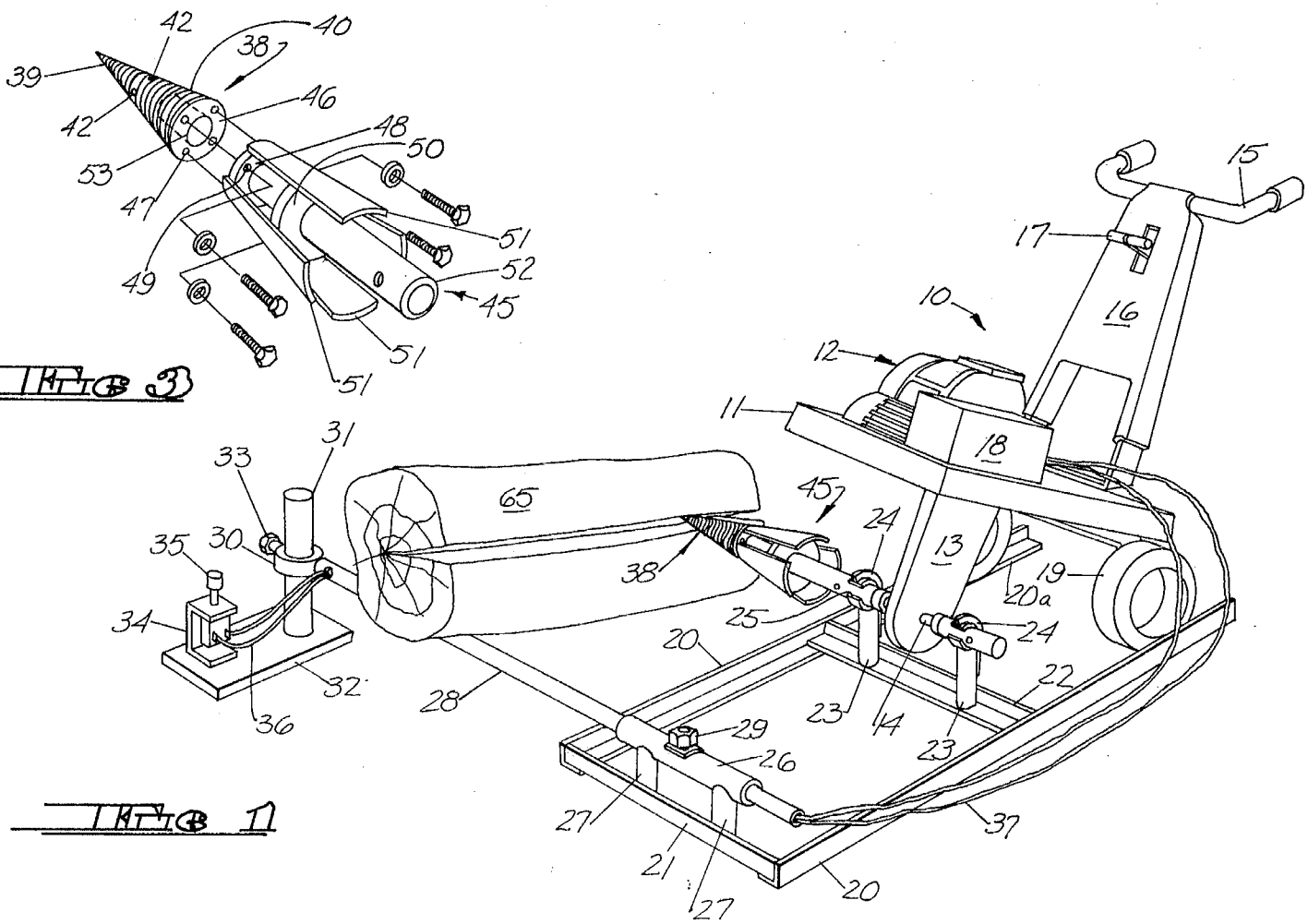
FIG. 1 is a prespective view of a garden tiller and associated log splitter attachment showing the auxiliary support assembly, screw auger, kill switch, garden tiller itself, and the log as it is being operated on by the auger screw.
FIG. 3 is a perspective view of the auger point, auger cone and auger adaptor.

Referring first to FIG. 1, the general arrangement of a conventional garden tiller as associated with the log splitter attachment of this invention is depicted. The garden tiller, generally indicated at 10, comprises a tiller frame 11 on which is mounted a motor 12 drivingly connected via a transmission (not shown) located within the transmission housing 13 and drivingly connected to the tiller tine shaft 14. The handles 15 are connected in conventional manner through the member 16 to the frame 11. Control means 17 are associated with the member 16 and suitably connected in known manner with the control mechanism 18 for actuating and deactuating the motor 12. Ground engaging wheels 19 are also connected to the frame 11.

The rectangular support assembly frame includes a pair of elongated, parallel channel members 20. At one end these members 20 are joined by a first cross brace 21. A second cross brace 22 parallel to the first cross brace 21 is located intermediate the ends of the members 20 to which members it is securely fastened as by welding and the like; the cross member 21 is similarly attached to the members 20. Preferably the members 20 extend beyond the second cross member 22 so as to provide flanges 20*a* on which the support wheels 19 of the garden tiller 10 may rest when the auger is to be used.

A pair of vertical standards 23 are firmly attached to the second cross member 22. Each of these members 23 terminates in a slotted, but otherwise cylindrical, bearing member 24. The slots for such cylindrical bearing members 24 are indicated at 25. As illustrated, the cross member 22 may be engaged to the elongated members 20 via those members and the flanges 20*a* thereof by means of welding and the like.

A cylindrical, elongated bearing member 26 is firmly affixed to the upper ends of a pair of vertical support members 27 which are securely affixed to the first cross member 21. A cylindrical rest arm 28 is adapted to be just nicely received within the elongated cylindrical bearing member 26; this rest arm 28 may be moved axially through the bearing member 26 to a desired position and then held in place by tightening the lock bolt and the like 29.

That end of the rest arm 28 which is removed from the cylindrical bearing 26 terminates in an annular ring 30 which will just nicely be received by the vertical, cylindrical support member 31 which is firmly fastened to the ground engaging base plate 32. The rest arm 28 may be secured in desired vertical position on the member 31 by means of a lock bolt and the like 33 located in the ring 30. A bracket member 34 is suitably affixed to the base plate 32. This bracket 34 supports a kill switch 35 which is connected by a suitable wiring harness 36 and associated wiring 37 to the controls 18 for the motor 12. It will be understood by those skilled in the art that when the motor has been actuated via the member 17 to rotate the tine shaft 14 and associated auger mechanism to be described, such actuation of the motor 12 and shaft 14 may be "killed" by actuation of the switch 35 by the operator via either hand or foot.

The screw assembly is generally indicated at 38 in FIG. 1. Such assembly is shown in greater detail in FIG. 2 which is now referred to. This screw assembly 38 includes an auger comprised of an auger point 39 and an auger cone 40 which may be fastened together by means of one or more roll pins 41 which may be press fitted through aligned orifices 42 and 43 in the auger cone 40 and auger point shaft 44, respectively. It will be understood that the auger point 39 is securely fastened to this shaft 44.

An auger adaptor, generally indicated at 45 in the Figures, is also provided. The auger cone section 40 (see FIG. 3) terminates in a circular end plate 46 having orifices 47 and the like therein to receive bolts and the like. The auger adaptor 45 includes a circular base plate 48 having orifices 49 therein by means of which the plates 48 and 46 may be bolted or otherwise suitably fastened together via the orifices 49 and 47 and suitable bolts and the like. The auger adaptor 45 also includes another circular plate 50, spaced from and of larger diameter than the plate 48. The plates 48 and 50 are parallel to one another. A plurality of cone axial sections 51 preferably having edges which parallel the edges of adjacent sections are secured, as by welding and the like, to the plates 48 and 50. These cone axial sections have approximately the same taper as do the auger 39 and auger cone 40. The auger adaptor 45 also includes a tubular shaft 52 securely located centrally thereof, as by being secured firmly to one or more of the plates 48 and 50; this shaft 52 may have an extension to engage within a bore 53 located in the end plate 46 of the auger cone 40. That end of the shaft 52 which extends beyond the ends of the auger adaptor sections 51 is provided with an orifice 54 to receive a clevis pin 55 by means of which the auger adaptor 45 and screw assembly 38 may be secured to the tiller tine shaft as will be described shortly.

Figure 2:
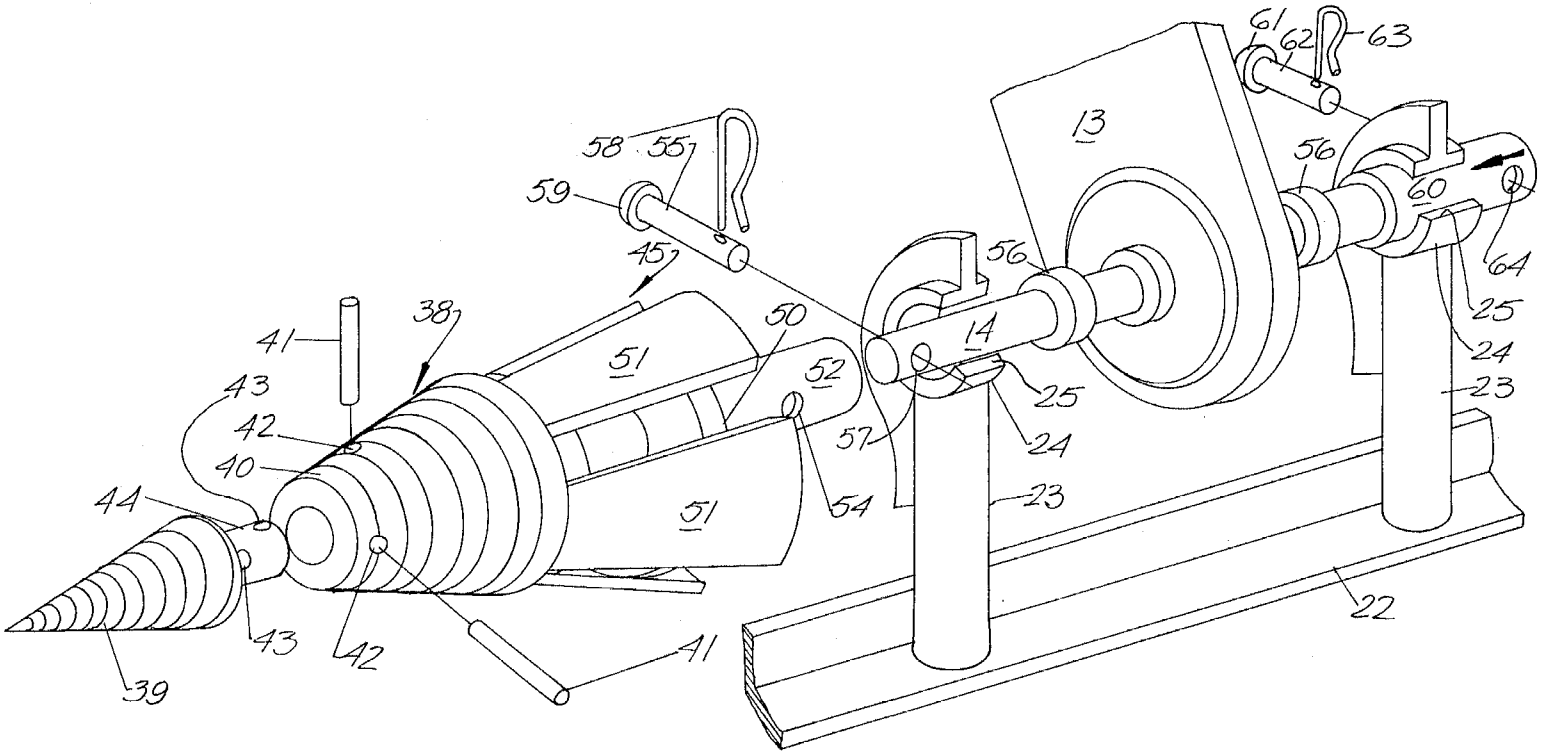
FIG. 2 is a fragmentary perspective view of the auger screw assembly and a portion of the auxiliary support frame structure.

Referring now particularly to FIG. 2 it will be observed that the slots generally indicated at 25 in the cylindrical bearing members 24 are of a dimension to permit the tiller tine shaft 14 to be simultaneously thrust into the bearings 24 via these slots 25. Before this is done, however, it is preferred that a pair of thrust spacers 56 be placed on the tine shaft 14. It will also be understood, of course, that the tiller tines have been removed from the shaft 14 prior to its having been so inserted into these cylindrical bearings 24. As above noted this shaft 14 is driven by suitable transmission means located within the housing 13 and operatively connected to the motor or power source 12.

In readying the log splitter for actuation, the shaft 52 for the combined auger adaptor 45 and screw assembly 38 is slid axially onto the tine shaft 14 within the cylindrical bearing 24 whereafter the clevis pin 55 is inserted through the orifice 54 and an orifice 57 located in the tine shaft 14. A hairpin 58 or the like is then passed through that end of the clevis pin 55 which extends beyond the aligned openings 54 and 57; a head 59 is provided at the other end of the clevis pin 55.

That end of the tine shaft 14 which is opposite that end to which the now combined auger adaptor 45 and screw assembly 38 are secured is adapted to receive a cylindrical spacer 60 which will be slid onto the tine shaft 14 so that this spacer 60 extends beyond both sides of the cylindrical bearing member 24. A headed clevis pin 61, 62 and hairpin 63 will hold this spacer member 60 in place on the tine shaft 14, aligned orifices for reception of the clevis pin being provided for that purpose, the orifice for the spacer 60 being shown at 64.

The diameters of the shaft 52 and spacer 60 are such as to permit them to be just nicely located on the tine shaft 14 within the cylindrical bearings 24 but of such diameters as to prevent their being forced or otherwise passed through the slots 25. The shaft 52 and spacer 60 will rotate with the tine shaft 14 so that there is no direct wear on the exterior of the shaft 14 due to its rotation within the bearings 24.

The auger point 39 may be made of hardened steel and as such it constitutes a replaceable tip for the screw assembly 38. The auger adaptor 45 helps to prevent log hangup. The safety switch 35, usually positioned for foot operation, is conveniently located to the operator during the log splitting operation. By virtue of the shaft 52 and spacer 60 being fastened to the tine shaft 14, they will rotate therewith and prevent wear on such tine shaft. The frame is comprised of heavy welded steel angle irons and tubing such as the members 20, 21, 22, and 28. The support bar 28 being extensible within the bearing 26 makes it easy to accommodate logs of different diameters. When assembled the tiller log splitter attachment securely fastens the tiller and support bar to the heavy steel support frame, thus forming one rigid complete unit for stability, safety and ease of operation.

When the log splitter attachment for garden tiller is assembled and connected to the tiller as illustrated in FIGS. 1 and 2, the operator will place one end a log 65 to be split so that that end rests on the support bar 28, the other end of the log being in position to be moved into contact with the screw assembly 38; preferably that end of the log 65 which rests on the support bar 28 should extend beyond that bar a few inches for the sake of added safety. The control members 17 and 18 having been engaged so as to actuate the motor 12, the shaft 14 and the screw assembly 38 thereon will now be rotating. At this point the operator simply slides the log 65 on the bar 28 and into engagement with the hardened steel replaceable tip 39 of the screw assembly 38. As noted above this screw tip 39 comprises a part of the screw assembly 38 which also includes the auger cone 40. These flared members 39 and 40, in cooperation with a similarily flared auger adaptor 45, make for an arrangement requiring less horsepower during splitting and helps eliminate potential "hanging up" of any logs on the base of the cone. When the log 65 is thus brought into engagement with the screw assembly 38 (auger 39, 40), the auger literally screws itself into the side of the log until the log splits open. The halves of such log 65 can then be put back on the log splitter attachment, if desired, for further splitting into quarters, or smaller. The operator simply rests the log on the support bar and touches it to the tip of the turning screw auger and splitting of the log follows directly. If per chance any unforseen difficulties should be encountered the mechanism may be immediately shut off by the operator by actuating the switch 35.

It will be understood by those skilled in the art that modifications may be made in this invention without departing from the scope and spirit thereof. In this connection it will be observed that the kill switch 35 is operatively connected to the controls 18 for the motor 12 via the wiring harness 36 and wires 37 which are shown as extending through the tubular log support bar 28. It obviously is not absolutely necessary that these wires be so located although this has proved to be a very neat arrangement. As indicated, other modifications will occur to those skilled in the art.

It is to be further understood that while this invention has been shown and described in connection with certain particular structures and arrangements, the invention is not to be limited to those certain particular structures and arrangements except insofar as they are specifically set forth in the subjoined claims.

What we claim is:

1. A log splitter attachment for a garden tiller and the like, said log splitter attachment comprising: a rigid support assembly including a substantially horizontal ground engaging base frame, a first vertical support member affixed to said base frame, a tiller tine shaft receiving bearing member mounted adjacent the upper end of said first vertical support member, a second vertical support member affixed to said base frame and spaced from said first vertical support member, and a support bar receiving member mounted adjacent the upper end of said second vertical support member; a screw assembly including an auger shaft and an auger affixed thereto, said auger shaft being adapted to engage a said tiller tine shaft received in said tiller tine shaft receiving bearing member and to be rotatable therewith; and an elongated support bar for receiving a log to be split thereon, one end of said support bar being adapted to be received by said support bar receiving member, and a ground engaging stand to receive the other end of said support bar; said auger shaft and said support bar being substantially parallel to one another; whereby when one end of said log is rested on said support bar and said log is moved into engagement with said auger when said auger and said auger shaft are being rotated by engagement of said auger shaft with said tiller tine shaft, said auger will screw itself into said log until said log splits open.

2. The attachment of claim 1 in which said rigid support assembly includes an additional tiller tine shaft receiving member, and a spacer bearing member adapted to be placed on a said tiller tine shaft and to be received in said additional tiller tine shaft receiving member.

3. The attachment of claim 2 in which both of said tiller tine shaft receiving members are generally cylindrical, each said tiller tine shaft receiving member being slotted just sufficiently to permit a said tiller tine shaft to be passed therethrough, said auger shaft and said spacer bearing member being slidable on a said tiller tine shaft axially thereof so that each is receivable in a said tiller tine shaft receiving member, the said auger shaft and said spacer bearing member having outside diameters greater than the width of said slots.

4. The attachment of claim 3 in which the said tiller tine shaft receiving members are spaced from one another so as to permit any transmission means for such a tiller tine shaft to be located therebetween, and a pair of thrust spacers adapted to be placed on such a tiller tine shaft, one on either side of such a transmission means, one said thrust spacer being located on a said tiller tine shaft between the transmission means and the said auger shaft and the other said thrust spacer being located on a said tiller tine shaft between the transmission means and the said spacer bearing member.

5. The attachment of claim 3 in which each of said auger shaft and said spacer bearing member is provided with removable lock means to secure said auger shaft and said spacer bearing member to said tiller tine shaft for rotation therewith.

6. The attachment of claim 1 in which said base frame includes extended members on which a garden tiller rests when the tiller tine shaft thereof is received in said tiller tine shaft receiving bearing member of said log splitter attachment.

7. The attachment of claim 1 in which said screw assembly includes an auger adaptor and means to secure said auger adaptor to said auger and to said auger shaft, said auger adaptor including a plurality of axial cone sections parallel to one another and having an outwardly flaring taper constituting a substantially continous configuration of the taper of the auger.

8. The attachment of claim 1 in which said auger includes a replaceable auger point and an auger cone.

9. The attachment of claim 1 in which said ground engaging stand includes a safety switch for disengaging power to said tiller tine shaft.

10. A log splitter attachment for garden tillers and the like having a tiller tine shaft, said attachment comprising: a rigid ground engaging base frame, said base frame including a log support member, a tiller tine shaft support member, and a tiller support member, whereby the tiller is fully supported by said base frame; a screw assembly, said screw assembly including an auger screw to engage and screw into a log, and an auger shaft on said screw assembly to engage the tiller tine shaft for rotation therewith and to be supported by said tiller tine shaft support member of said base frame, said auger screw extending beyond a side of said base frame; and a log support structure, said structure including first means to be received in said log support member of said frame, and second ground engaging means removed from said frame, said log support structure being spaced from said screw assembly and said log support structure extending beyond the same said side of said base frame as said auger screw; whereby when an operator places a log on said log support structure and moves said log into contact with said auger screw while said auger screw is rotating with the said auger shaft and the tiller tine shaft, said auger screw will screw itself into the side of the log until the log splits open.

11. The attachment of claim 10 in which said log support member includes a vertical support extending from said base frame and a tubular bearing affixed to said vertical support; said tiller tine support member includes vertical support means and a pair of spaced cylindrical bearing members affixed to said vertical support means, said cylindrical bearing members being slotted for simultaneous reception therethrough of said tiller tine shaft, and one of said cylindrical bearing members being large enough to just nicely receive axially thereof the said auger shaft of said screw assembly, the tiller tine shaft being received in said auger shaft; and said log support structure includes a cylindrical bar for insertion into said tubular bearing member axially thereof, said cylindrical bar receiving said log thereon.

12. In a log splitter attachment for garden tillers and the like having a tiller tine shaft driven through transmission means engaging said tiller tine shaft centrally thereof, a bearing arrangement for reception of the tiller tine shaft of the garden tiller, said bearing arrangement comprising: a rigid ground engaging base frame; a pair of spaced vertical standards fixed to and extending from said base frame; first and second axially aligned cylindrical bearing members affixed adjacent respective ends of said vertical standards removed from said base frame, each of said cylindrical bearing members having a slot therein parallel to the axis thereof and of a size to permit said tiller tine shaft to pass simultaneously through said slots into said bearing members, said cylindrical bearing members being spaced apart sufficiently to receive said transmission means therebetween; one of said cylindrical bearing members being of a size to permit a hollowed auger shaft to be received axially thereof and said tiller tine shaft being of a size to engage within said hollowed auger shaft when said auger shaft is slid into said one cylindrical bearing member and onto said tiller tine shaft, the outer diameter of said hollowed auger shaft being greater than the width of the said slot in said one cylindrical bearing member; and the other of said cylindrical bearing members being of a size to permit a tubular spacer to be received axially thereof and said tiller tine shaft being of a size to engage within said tubular spacer when said tubular spacer is slid into said other cylindrical bearing member and onto said tiller tine shaft, the outer diameter of said tubular spacer being greater than the width of the said slot in said other cylindrical bearing member.

13. In combination: a garden tiller comprised of a frame member, a transmission means on said frame member, motor means on said frame member to actuate said transmission means, a tiller tine shaft supported from said frame member and driven by said motor means through said transmission means, control means for controlling actuation of said motor means, and ground engaging means for said garden tiller affixed to said frame member; and a log splitter attachment for said garden tiller, said attachment comprising: a rigid ground engaging base frame, said base frame including a log support member, a tiller tine shaft support member and a tiller support member to receive said ground engaging means for said garden tiller whereby the tiller is fully supported by said base frame; a screw assembly, said screw assembly including an auger screw to engage and screw into a log, and an auger shaft on said screw assembly to engage the tiller tine shaft for rotation therewith and to be supported by said tiller tine shaft support member of said base frame, said auger screw extending beyond a side of said base frame; and a log support structure, said structure including first means to be received in said log support member of said frame, and second ground engaging means removed from said frame, said log support structure being spaced from said screw assembly and said log support structure extending beyond the same said side of said base frame as said auger screw; whereby when an operator places a log on said log support structure and moves said log into contact with said auger screw while said auger screw is rotating with the said auger shaft and the said tiller tine shaft, said auger screw will screw itself into the side of the log until the log splits open.

14. The combination of claim 13 including a kill switch located adjacent said log support structure and operatively connected to said control means.

15. A log splitter attachment for use with garden tillers having a tiller frame, a tiller power drive means, and a tiller drive shaft, said splitter attachment comprising: a frame portion, attachment means mounted on said frame portion to releaseably attach said frame portion to said tiller drive shaft, a log splitting screw having means attached thereto for releaseable attachment to said tiller drive shaft to allow for rotational movement of said splitting screw in unison with said tiller drive shaft and in generally axial alignment therewith, and a log support bar attached to said frame portion and extending outwardly therefrom for ground engaging support, to provide support for logs during use and to stabilize said frame portion and said tiller.

* * * * *